US005340175A

United States Patent [19]

Wood

[11] Patent Number: 5,340,175

[45] Date of Patent: Aug. 23, 1994

[54] PORTABLE SECURITY DOOR STOP

[76] Inventor: Clifford C. Wood, 2520 Terrella Pl., Escondido, Calif. 92025

[21] Appl. No.: 90,717

[22] Filed: Oct. 4, 1993

[51] Int. Cl.[5] ..... E05C 17/54

[52] U.S. Cl. ..... 292/339

[58] Field of Search ..... 292/338, 339, 262

[56] References Cited

U.S. PATENT DOCUMENTS

| | | | |
|---|---|---|---|
| 4,483,558 | 11/1984 | Van Meter | 292/339 |
| 4,607,253 | 8/1986 | Wooten et al. | 292/339 X |
| 4,819,296 | 4/1989 | Wilkins | 292/339 X |
| 4,883,297 | 11/1989 | Smith | 292/339 |
| 4,973,093 | 11/1990 | Olszowka | 292/339 |
| 5,135,273 | 8/1992 | MacCalder | 292/333 |

*Primary Examiner*—Rodney M. Lindsey
*Attorney, Agent, or Firm*—Ralph E. Walters

[57] ABSTRACT

The present invention relates to a portable security door stop for dependably holding a door in a closed position again any unauthorized entry which may be quickly and conveniently installed on the inside of the door. The invention provides a door handle engaging yoke which is virtually impossible to dislodge from the door; has a convertible floor engaging member having a plurality of cleats for use of carpet but which are also adaptable to provide a mounting system for an auxiliary resilient block or pad adapted for use on relatively hard floor surfaces; and including an audio-alarm unit closely associated with the yoke which is triggered by even the inward movement of the door against the stop. The stop further includes upper and lower telescoping sections with a lock pin selectively extendable through a pair of sets of aligned apertures in the sections to hold them in predetermined extended and retracted positions; and an elongated slot in the lower section slidably receiving a pin in the upper section engageable with the ends of the slot precisely to align said pairs of sets of apertures.

9 Claims, 1 Drawing Sheet

PORTABLE SECURITY DOOR STOP

TECHNICAL FIELD

The present invention generally relates to a portable security door stop for doors having an actuating handle to manipulate the door between predetermined open and closed position and more particularly to such a door stop, adapted to be releasibly disposed in angularly bracing relation between the door handle and an adjacent floor surface to maintain the door in its closed position against any intruder attempting to open the door from its opposite side.

BACKGROUND ART

Heretofore, portable bracing-type security door stops have been commercially available which have typically consisted of an elongated rod providing an upper door handle engaging end and an opposite floor engaging end which can be propped against the inner side of the door as an extra precautionary measure to preclude unauthorized entry therethrough in houses, businesses and particularly in other public places such as hotels and the like, where the normal security locks and the like might not be considered adequate. Of course, broom handles and other stick-like braces have been used for years in the home without much degree of success because of the lack of portability and difficulty in maintaining them in dependable bracing position since they are easily dislodged by even the slightest shaking movement of the door. An example of such a commercially available doorstop provides an elongated tubular rod which, while even though longitudinally adjustable, does not have sufficient holding capability to ensure it remains in place under even less than extreme situations. The upper door handle engaging end is somewhat blunt and only incorporates a rather shallow scallop or groove which requires wedging against the underside of the doorknob or other handle structure of the door which can be easily dislodged. Likewise, the opposite floor engaging end of the brace has a foot member connected to the rod by a complicated and costly ball and socket-type joint which would permit the rod to be swung away from the door in any direction from even the slightest jarring forces that might be applied to the outside of the door by a potential intruder. Furthermore, such unit has no way of accommodating a wide variety of floor surfaces to preclude slippage from a relatively soft carpet to the harder and slicker floor surfaces such as wood, slate, tile and the like. Further, none of such prior art devices afford any audible indication of a potential forced entry other than the usual relatively quiet attempted manipulation of the door knob or other handle device. Consequently, it is recognized that an improved security door stop could be provided having a greatly simplified structure providing an audible alarm system which is easily and conveniently installed on the door handle engaging member and which may be quickly and dependably oriented with a floor engaging foot member that is capable of accommodating a wide variety of floor surfaces. Accordingly, the present invention is intended to overcome the problems as set forth above.

DISCLOSURE OF THE INVENTION

In accordance with one aspect of the present invention, there is provided a security door stop for releasably bracing a door against an unauthorized opening which utilizes an elongated stop rod having a depressible door handle engaging yoke capable of actuating an audio-sound generating unit therein and a floor engaging foot member providing an auxiliary pad in order to accommodate a wide variety of floor surfaces in which a mounting system for the pad can be selectively used by itself or alternatively provides the connection for mounting the pad thereon.

BEST MODE FOR CARRYING OUT THE INVENTION

Figures 1, 2, 3, 4, 5:
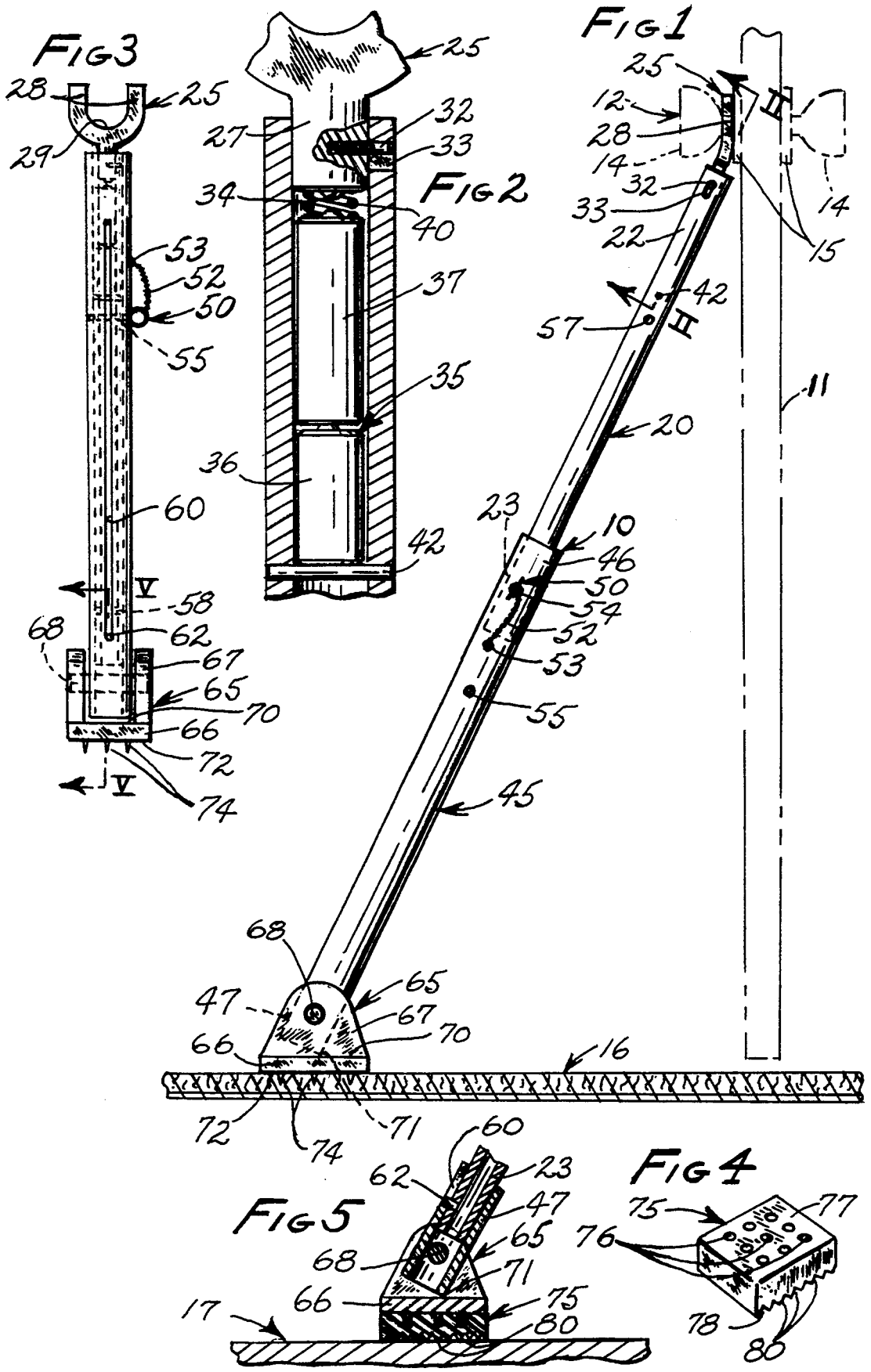
FIG. 1 is a side elevational view of the portable security door stop of the present invention showing the stop in an extended operating position on a door and a carpeted floor surface.
FIG. 2 is a somewhat enlarged fragmentary cross-sectional view through the upper-door handle engaging end of the stop taken generally along the line II—II of FIG. 1.
FIG. 3 is side elevational view of the portable security door stop showing it in a retracted transporting position removed from the door.
FIG. 4 is a three-dimensional view of an auxiliary pad for selective mounting on the foot member of the stop adapting it for use on relatively hard floor surfaces.
FIG. 5 is a fragmentary cross sectional view taken through the lower end of the stop generally along the line V—V of FIG. 3 but with the pad of FIG. 4 installed in operating position thereon.

Referring more particularly to FIG. 1 of the drawing a portable security door stop embodying the principles of the present invention is generally indicated the reference numeral 10. The stop is adapted to be utilized with, for example, a swinging-type door 11 having a knob-type lock set generally indicated by the reference numeral 12 mounted thereon. The lock set has a pair of inner and outer hand gripping knobs 14 with a pair of corresponding circular escutcheon plates 15. Beneath the door is a carpeted (FIG. 1) floor surface 16 or alternatively a hard surface floor 17 of FIG. 5. It is apparent that the lock set may have any type of handle gripping members customarily employed on either swinging or sliding-type doors currently in use.

The security door stop 10 of the present invention includes an elongated tubular upper section 20 of any substantially rigid material such as steel, aluminum or the like, having opposite upper and lower ends, 22 and 23, respectively. A knob or door handle engaging yoke 25 is constructed of a substantially flat rigid material having a cylindrical shank 27 slidably extended into the upper end 22 of the upper section 20. The yoke further includes outwardly extended U-shaped fingers 28 interconnected by a bight portion 29. The fingers are angularly extended from the shank at an obtuse angle in order to lie substantially parallel to the door 11 when the stop is installed at its optimum propping position against the door as shown in FIG. 1. As best shown in FIG. 2, the shank carries a pin 32 which is slidable through a slot 33 in the upper end of upper section 22 permitting limited axial sliding movement of the yoke in the upper section but restricting complete separation of the yoke therefrom. An electrical contact 34 is formed on the end of the shank 27 for a purpose hereinafter to be described.

An electrically battery powered audio alarm unit 35 is slidably disposed within the tubular upper section 22 inwardly adjacent to the shank 27 of the yoke 25. The alarm unit consists of a sounding device 36 and a battery 37 electrically connected by a suitable series-type wiring circuit, not shown, with the contact 34 on the shank of the yoke. The battery and yoke contacts are normally held in closely spaced relation by a compression spring 40 disposed therebetween urging the yoke to an outwardly extended position normally interrupting the alarm circuit. The alarm unit is supported on a pin 42 transversely extended through the upper section 20 of the stop.

The security door stop 10 further provides a lower tubular section 45 having an inside diameter slightly larger than the outer diameter of the upper section 20 permitting the sections to be telescopically slidable between their maximum extended and retracted positions of FIGS. 1 and 2, respectively. The lower section has an upper end 46 and an opposite lower end 47. A ring-type lock pin 50 is connected to an elongated flexible chain 52 which is secured to the lower section as by a spot weld or small metal screw at an anchor point 53. The anchor point is approximately midway between a pair of upper and lower lock pin holes 54 and 55, respectively through the lower section 45. These are respectively alignable with a pair of upper and lower lock pin holes 57 and 58 through the upper section 20. An elongated longitudinally extended slot 60 is formed in the lower section in order to accurately align the lock pin holes at each end of travel between the upper and lower sections by a stop pin 62 mounted on the lower end 23 of the upper section which is extended radially outwardly therefrom in sliding engagement through the slot 60.

A floor engaging foot member 65 is pivotally mounted on the lower end 47 of the lower section 45 and has a lower plate 66 providing a pair of integral, upwardly extended spaced ears 67. A pivot pin 68 is extended therethrough to permit limited pivotal movement which is restricted by the lower edges of the lower section contacting an upper surface 70 of the plate at 71. The plate further includes an opposite lower surface 72 which has a plurality of downwardly extending projections or cleats 74. An auxiliary floor engaging pad or block 75 of any suitable resiliently flexible material such as rubber or the like is provided for selective mounting on the foot member 65. To facilitate such mounting, a plurality of concavities 76 are formed in an upper surface 77 of the block in direct correspondence to the number of cleats 74 in the foot member 65. An opposite lower surface 78 of the block has a plurality of serrations 80 for a purpose hereinafter to become apparent.

INDUSTRIAL APPLICABILITY

The security door stop 10 of the present invention is usually stored or carried from place to place in its retracted position of FIG. 3. When it is desired to dependably block access through the door 11, the upper section 20 is manually pulled outwardly from the lower section 45 after removal of the ringed lock pin 50 from locking holes 55 and 57. Full extension of the sections is achieved when the stop pin 62 reaches the upper end of slot 60 at which position the lock pin holes 54 and 58 are precisely aligned permitting the insertion of lock pin 50 therethrough. The fingers 28 of the yoke 25 are slipped upwardly behind the door knob 14 and against the associated escutcheon plate 15. The security door stop is then swung downwardly until the lower surface 72 of the foot member 65 engages the adjacent floor surface 16–17 in the desired angular propping position behind the door. As the foot member 65 is permitted to pivot, the foot member is automatically disposed in fully contacting substantially flat engagement with the floor surface. At this time, further pivoting is prevented by the lower edge of the lower section 45 coming into interfering contact with the upper surface 70 of the plate 66 as at 71 thus holding the foot member in such optimum flat position dependably to transfer any axial forces through the stop uniformly over the entire surface of the foot member. If the door stop is used on the carpeted surface 16 of FIG. 1, the resilient block 75 is first removed permitting the cleats 74 to penetrate the pile of the carpet to hold the stop in its desired bracing position relative to the door. Alternatively, if the hard surface 17 is encountered as in FIG. 5, the resilient block can be easily and conveniently installed by sliding the cleats into the concavities 76 and pressing the block into intimate contacting relation with the lower surface 72 of the foot member 65. In such event, the serrations 80 on the lower surface 78 of the block provide nonskidding engagement with even the slickest of floor surfaces. Either of such installation procedures further causes the spring 40 to be somewhat compressed but still maintaining some spacing between the yoke contact 34 and the battery 37 of the alarm unit. It will be readily apparent, however, that with even the slightest inward pressure on the door 11, spring 40 will be further compressed causing the yoke contact 34 to engage the battery 37 immediately activating the alarm unit 36 to signal any such tampering on the outside of the door.

After use, the portable door stop 10 of the present invention can be quickly disengaged from the door 11 by removing the locking pin 50 and telescoping the sections 20 and 45 together until the stop pin 62 engages the lower end of the slot 60 as in FIG. 3. The doorstop is then dependably locked in its retracted storage or transport position by reinstalling the lock pin 50 in lock holes 55 and 57.

In view of the foregoing, it is readily apparent that the structure of the present invention provides an improved security door lock affording quick and convenient installation on the inside of a door with the handle engaging yoke easily slipping behind and around the handle to preclude separation therefrom irrespective of how violently the door might be disturbed by an unauthorized intruder. The built-in angularity of the yoke precisely positions the stop at an optimum bracing angular relation to the door and to the floor surface for maximizing the floor gripping effectiveness of the foot member which is maintained at such angle by the interfering engagement of the lower edge of the stop with the upper surface of the foot member. The auxiliary block quickly converts the foot member for use on a wide variety of floor surfaces without the need of any special tools by utilizing the cleats both as a mounting system for the block and for optimum use on a carpeted floor surface when the hard surface block is removed. The security door stop of the present invention is further easily manipulated between its retracted and extended operating positions by selective use of the ringed locking pin in the closely longitudinally spaced lock pin holes with precise alignment of the sets of holes in the upper and lower sections of the stop being assured by the elongated slot and pin structure therebetween which also preclude complete separation of such upper and lower stop sections.

I claim:

1. A portable security door stop, for doors having a handle normally to manipulate such a door between predetermined open and closed positions, comprising;

an elongated hollow brace having an upper door handle engaging end, and an opposite lower floor engaging end telescopically receiving said upper door handle engaging end and adapted to be angularly propped against the door in its closed position to preclude movement of the door toward its open position;

said upper door handle engaging end of the brace providing a substantially flat plate-like yoke obtusely angularly extended from said upper end of the brace and having oppositely spaced fingers for releasably receiving said door handle embraceably therebetween;

a battery powered alarm unit disposed within said upper door handle engaging end of the brace for energization by movement of the door toward its open position; and said yoke being longitudinally slidably mounted within said upper end of the hollow brace for inward sliding contact with said alarm unit during said movement of the door against said brace.

2. The portable security door stop of claim 1 further including a lock pin selectively extendable through a pair of sets of aligned aperture in said upper and lower ends of the brace for holding them in predetermined extended and retracted positions, and a chain connected at one of its ends to the lock pin and at its opposite end to the lower end of the brace at a point substantially midway between said apertures.

3. The portable security door stop of claim 2 including an elongated slot in said lower end of the stop terminating in opposite ends adjacent to upper and lower sections of the lower end;

and a pin carried by said upper end being slidably extended into said slot and being engageable with said ends of the slot precisely to align said pairs of sets of apertures in said upper and lower ends in their extended and retracted positions.

4. The portable security door stop of claim 1 wherein said battery powered alarm unit includes a dry cell battery, an audio sound-generating unit, and an electrical wiring circuit interconnecting said battery and said sound-generating unit in series arrangement;

said yoke including an electrical contact connected into said wiring circuit;

and a compression spring disposed between said yoke contact and said battery normally maintaining them in spaced relation to each other.

5. The portable security door stop of claim 1 further comprising;

a foot member pivotally mounted on said lower end of said brace having a lower plate providing spaced upwardly extended ears embracing said lower end of the brace, and a pivot pin extended through said ears and the lower end of said brace;

said plate including a substantially flat upper surface and an opposite lower surface providing an irregular profile for anti-skid engagement with a relatively soft carpeted floor surface; and a pad of relatively soft resiliently flexible material having an upper surface removably mountable upon said lower surface of said plate and an opposite irregularly shaped lower anti-skid surface for non-skidding engagement with a relatively hard floor surface.

6. The portable security door stop of claim 5 in which said lower surface of said plate has a plurality of downwardly extended projections;

said resilient pad has a corresponding number of concavities for receiving said projections for selectively removably mounting said pad on said plate of the foot member, and said lower surface of the pad having a plurality of serrations for non-skidding engagement with a relatively hard floor surface.

7. A portable security door stop for doors having a handle normally to manipulate the door between predetermined open and closed positions, comprising;

an elongated brace having a tubular upper handle engaging section disposed in longitudinally slidable telescoping relation within a tubular lower floor engaging section for propping against such a door in its closed position to preclude movement of the door toward its open position;

a U-shaped yoke having a pair of oppositely spaced fingers for releasably receiving such a door handle therebetween, and an elongated cylindrical integral shank portion slidably fitted in an upper end of said upper section of the brace, with an electrical contact provided on the inner end thereof, and means to preclude separation of said yoke from said upper section of the brace;

a battery powered audio-alarm unit disposed within said upper section of the brace inwardly adjacent to said shank portion of the yoke, and including a compression spring disposed between said electrical contact on the shank portion and said audio-alarm unit in normally separating relation, with the yoke being depressible for energizing said audio-alarm unit upon a predetermined movement of said door against said brace;

a foot member pivotally mounted on a lower end of said lower section of the brace having a lower surface providing a plurality of downwardly extending projections for non-skidding engagement with a carpeted floor surface;

and an auxiliary pad of resiliently flexible material providing a plurality of spaced openings therein to receive said projections of said foot member to releasably maintain them in assembly for non-skidding engagement of the foot member with a relatively hard surfaced floor.

8. The portable security door stop of claim 7 further including a lock pin selectively extendable through a pair of sets of aligned aperture in said upper and lower sections of the brace for holding them in predetermined extended and retracted positions, and a chain connected at one of its ends to the lock pin and at its opposite end to the lower section of the brace at a point substantially midway between said apertures.

9. The portable security door stop of claim 8 including an elongated slot in said lower section of the stop terminating in opposite ends adjacent to said upper and lower ends of the lower section;

and a pin carried by said upper section being slidably extended into said slot and being engageable with said ends of the slot precisely to align said pairs of sets of apertures in said upper and lower sections in their extended and retracted positions.

* * * * *